US006710679B2

(12) United States Patent
Zhu

(10) Patent No.: US 6,710,679 B2
(45) Date of Patent: Mar. 23, 2004

(54) ANALOG RAT-RACE PHASE SHIFTERS TUNED BY DIELECTRIC VARACTORS

(75) Inventor: Yongfei Zhu, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/931,503

(22) Filed: Aug. 16, 2001

(65) Prior Publication Data

US 2003/0034858 A1 Feb. 20, 2003

(51) Int. Cl.[7] ..... H01P 3/00
(52) U.S. Cl. ..... 333/164; 333/161; 333/120
(58) Field of Search ..... 333/139, 156, 333/120, 257, 164

(56) References Cited

U.S. PATENT DOCUMENTS

| | | | | |
|---|---|---|---|---|
| 4,205,282 A | * | 5/1980 | Gipprich | 333/103 |
| 4,697,160 A | * | 9/1987 | Clark | 333/103 |
| 4,811,426 A | | 3/1989 | Pergande | |
| 5,028,892 A | | 7/1991 | Daughters | |
| 5,032,805 A | | 7/1991 | Elmer et al. | |
| 5,081,513 A | * | 1/1992 | Jackson et al. | 257/57 |
| 5,307,033 A | | 4/1994 | Koscica et al. | |
| 5,427,988 A | | 6/1995 | Sengupta et al. | |
| 5,561,407 A | | 10/1996 | Koscica et al. | |
| 5,635,433 A | | 6/1997 | Sengupta | |
| 5,635,434 A | | 6/1997 | Sengupta | |
| 5,693,429 A | | 12/1997 | Sengupta et al. | |
| 5,766,697 A | | 6/1998 | Sengupta et al. | |
| 5,830,591 A | | 11/1998 | Sengupta et al. | |
| 5,846,893 A | | 12/1998 | Sengupta et al. | |
| 5,847,620 A | | 12/1998 | Wong et al. | |
| 5,917,860 A | | 6/1999 | Lee | |
| 6,074,971 A | | 6/2000 | Chiu et al. | |
| 6,335,665 B1 | * | 1/2002 | Mendelsohn | 333/109 |

FOREIGN PATENT DOCUMENTS

| | | |
|---|---|---|
| JP | 08097602 | 4/1996 |
| JP | 10256805 | 9/1998 |
| WO | WO 00/24079 A1 | 4/2000 |

OTHER PUBLICATIONS

PCT International Search Report for International Application No. PCT/US02/25420 dated Oct. 17, 2002.

Kozyrev A et al. "Ferroelectric Films: Nonlinear Properties and Applications in Microwave Devices" Microwave Symposium Digest, 1998 IEEE, MTT–S Digest, pp. 985–988, Jun., 1998.

S. Kamihashi et al. "Novel PIN Diode for MIC Phase Shifter" Microwave Journal. vol. 23, No. 12, p. 49–52, 82, Dec. 1980.

(List continued on next page.)

*Primary Examiner*—Michael Tokar
*Assistant Examiner*—Linh Van Nguyen
(74) *Attorney, Agent, or Firm*—Robert P. Lenart; James S. Finn

(57) ABSTRACT

A phase shifter includes a first rat-race ring having four ports, an input coupled to a first one of the ports, an output coupled to a second one of the ports, a first resonant circuit coupled to a third one of the ports, and a second resonant circuit coupled to a fourth one of the ports, each of the first and second resonant circuits including a tunable dielectric varactor. The first rat race ring can be connected to another phase shifting stage including a second rat race ring or a digital switched line phase shifter.

2 Claims, 4 Drawing Sheets

OTHER PUBLICATIONS

Sharma AK "Solid–State Control Devices: State of the Art", 176 Microwave Journal, Suppl. 9, pp. 95–96, 98, 100–1, Sep. 1989.
U.S. patent application Ser. No. 09/594,837, Chiu, filed Jun. 15, 2000.
U.S. patent application Ser. No. 09/768,690, Sengupta et al., filed Jan. 24, 2001.
U.S. patent application Ser. No. 09/882,605, Sengupta, filed Jun. 15, 2001.
U.S. patent application Ser. No. 60/295,046, Chiu et al., filed Jun. 1, 2001.
B. Henoch et al., "A 360° Reflection–Type Diode Phase Modulator," *IEEE Trans. On Microwave Theory & Tech.,* vol. MTT–19, Jan. 1971, pp. 103–105.
B. Ulriksson, "Continuous Varactor–Diode Phase Shifter With Optimized Frequency Response," *IEEE Trans. On Microwave Theory & Tech.,* vol. MTT–27, Jul. 1979, pp. 650–654.

* cited by examiner

ANALOG RAT-RACE PHASE SHIFTERS TUNED BY DIELECTRIC VARACTORS

FIELD OF INVENTION

This invention relates generally to microwave devices and more particularly to analog phase shifters.

BACKGROUND OF INVENTION

Phased array antennas include a large number of elements that emit phased signals to form a radio beam. The radio signal can be electronically steered by the active manipulation of the relative phasing of the individual antenna elements. This electrically steered beam concept applies to both the transmitter and the receiver. Phased array antennas are advantageous in comparison to their mechanical counterparts with respect to their speed, accuracy, and reliability. The replacement of gimbal-scanned antennas by their electronically scanned counterpart increases antenna survivability through more rapid and accurate target identification. Complex tracking exercises can also be accomplished rapidly and accurately with a phased array antenna system.

A phase shifter is an essential element, which controls the phase of a microwave signal, in a phased array antenna. A good performance and low cost phase shifter can significantly improve performance and reduce the cost of the phased array, which should help to transform this advanced technology from recent military dominated applications to commercial applications.

Previous patents that disclose ferroelectric phase shifters include U.S. Pat. Nos.: 5,307,033, 5,032,805, and 5,561,407. The phase shifters disclosed therein include one or more microstrip lines on a ferroelectric (voltage-tuned dielectric) substrate to produce the phase modulating. Tuning of the permittivity of the substrate results in phase shifting when a radio frequency (RF) signal passes through the microstrip line. Microstrip ferroelectric phase shifters suffer from high conducting losses, high modes, DC bias, and impedance matching problems. Coplanar waveguide (CPW) phase shifters made from voltage-tuned dielectric films, whose permittivity may be varied by varying the strength of an electric field on the substrate have also been disclosed.

B. T. Henoch and P. Tamm disclosed a 360° varactor diode phase shifter in "A 360° Varactor Reflection Type Diode Phase Modulator,"IEEE Trans. On Microwave Theory and Tech., Vol. MTT-19, January 1971, pp. 103–105. Their design included two parallel coupled series resonant circuits that were connected to a circulator by means of a quarter-wave transformer. The transformer equalizes the insertion loss. However, the phase shifter showed large frequency dependence at phase shifts between 0° to 360°.

Ulriksson has modified the above design to optimize frequency response for all phase shifts up to 180° by introducing a slight change in one of the parallel coupled resonant circuits, see B. Ulriksson, "Continuous Varactor-Diode Phase Shifter With Optimum Frequency Response," IEEE Trans. On Microwave Theory and Tech., Vol. MTT-27, July 1979, pp. 650–654.

There is a need for analog phase shifters that are capable of operating at frequencies in the range of 1 to 18 GHz, wherein the phase shift can be electronically controlled.

SUMMARY OF INVENTION

Phase shifters constructed in accordance with this invention include a first rat-race ring having four ports, an input coupled to a first one of the ports, an output coupled to a second one of the ports, a first resonant circuit coupled to a third one of the ports, and a second resonant circuit coupled to a fourth one of the ports, each of the first and second resonant circuits including a tunable dielectric varactor.

A third resonant circuit can be connected in parallel with the first resonant circuit, and a fourth resonant circuit can be connected in parallel with the second resonant circuit. Each of the third and fourth resonant circuits can also include a tunable dielectric varactor.

In one embodiment, the first rat race ring can be connected to another phase shifting stage including a second rat race ring. Additional resonant circuits including tunable dielectric varactors can be connected to ports of the second rat race ring.

In another embodiment, the first rat race ring can be connected to a digital switched line phase shifting stage. The digital switched line phase shifting stage can include a first and second microstrip lines coupled to each other by first and second capacitors, an input coupled to the first microstrip line, and an output coupled to the second microstrip line, first and second PIN diodes connected between the first microstrip line and ground, third and fourth PIN diodes connected between the second microstrip line and ground, and means for applying a bias voltage to the first and second microstrip lines.

DETAILED DESCRIPTION OF THE PREFERRED EMBODIMENTS

Figure 1:
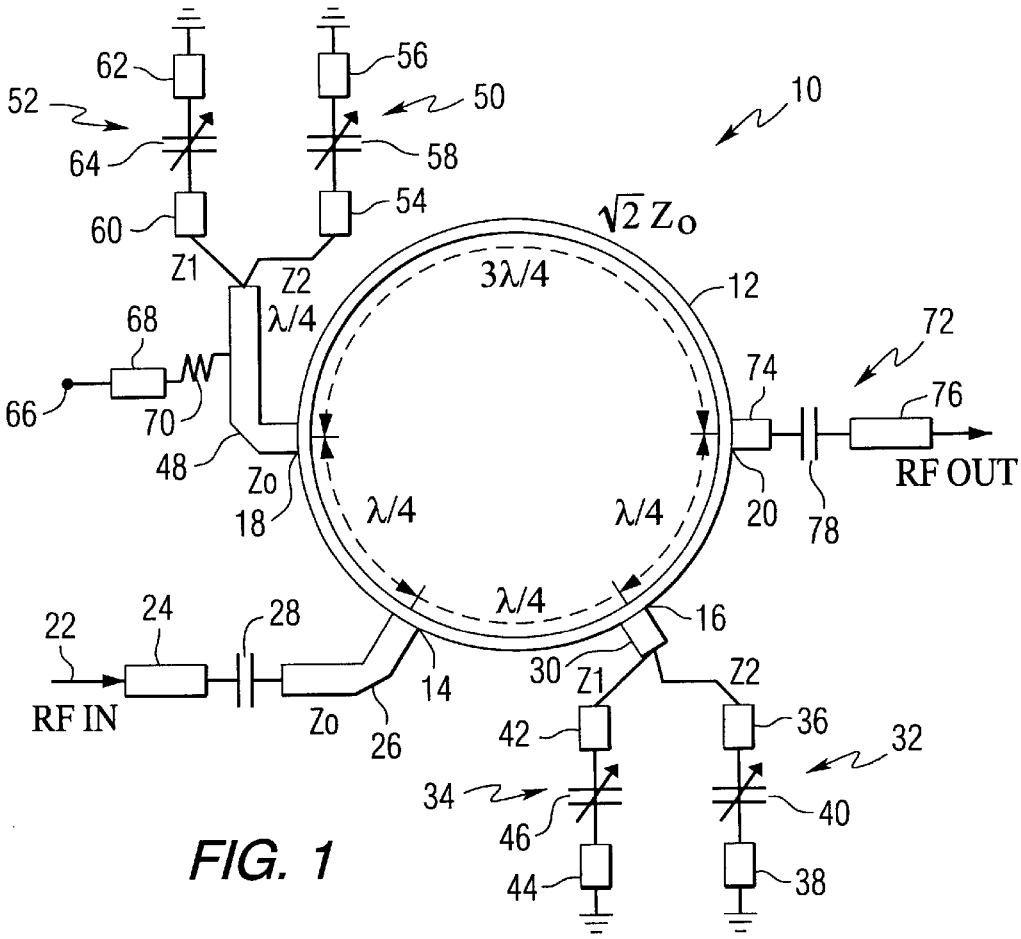
FIG. 1 is a schematic representation of a 180° analog dielectric varactor phase shifter constructed in accordance with this invention.

Referring to the drawings, FIG. 1 shows a schematic drawing of a 180° analog phase shifter 10 constructed in accordance with the present invention. The phase shifter 10 includes a rat-race ring 12 having four ports 14, 16, 18 and 20, and a characteristic input impedance of $Z_0$=50 ohm. Port 14 is connected to an input point 22 by way of the series connection of a microstrip lines 24 and 26, and capacitor 28. Port 16 is connected to line 30, which is in turn connected to a pair of parallel circuit branches 32 and 34 having impedances Z2 and Z1, respectively. Branch 32 includes the series connection of lines 36, 38 and capacitor 40. Branch 34 includes the series connection of lines 42, 44 and capacitor 46. One end of each of the circuit branches is connected to ground. The parallel circuit branches have components with slightly different electrical properties to improve the figure of merit and the frequency response of the phase shifter.

Port 18 is connected to line 48, which is in turn connected to a pair of parallel circuit branches 50 and 52. Branch 50 includes the series connection of lines 54, 56 and capacitor 58. Branch 52 includes the series connection of lines 60, 62 and capacitor 64. One end of each of the circuit branches is connected to ground. A terminal 66 is provided for connection to an external bias voltage supply. Terminal 66 is connected to line 48 through a circuit branch including the series connection of line 68 and resistor 70. In operation, an RF signal is input to port 14, equally divided between port 16 and port 18, and reflected in their short ends. Since the rat-race ring is an inherent 180° hybrid, an extra quarter-wavelength strip is added on port 18 to compensate for the 180° phase difference. Each termination of port 16 and port 18 has the same resonant circuits, which include two series-tuned circuits in parallel and connected to ground at the short ends. Each of the series-tuned circuits includes a high impendence microstrip line, as an inductor, and connects to a dielectric varactor with shorted end in series. It should be noted these two resonant circuits have slightly different inductance and capacitance to optimize frequency response. A DC voltage is input in port 18 through a resistor 70, working as a RF chock to avoid RF signal leak into the DC source. Two DC block capacitors 28 and 78 are mounted on input and output respectively to isolate varactor bias voltage from devices outside of the ring.

Figure 2:
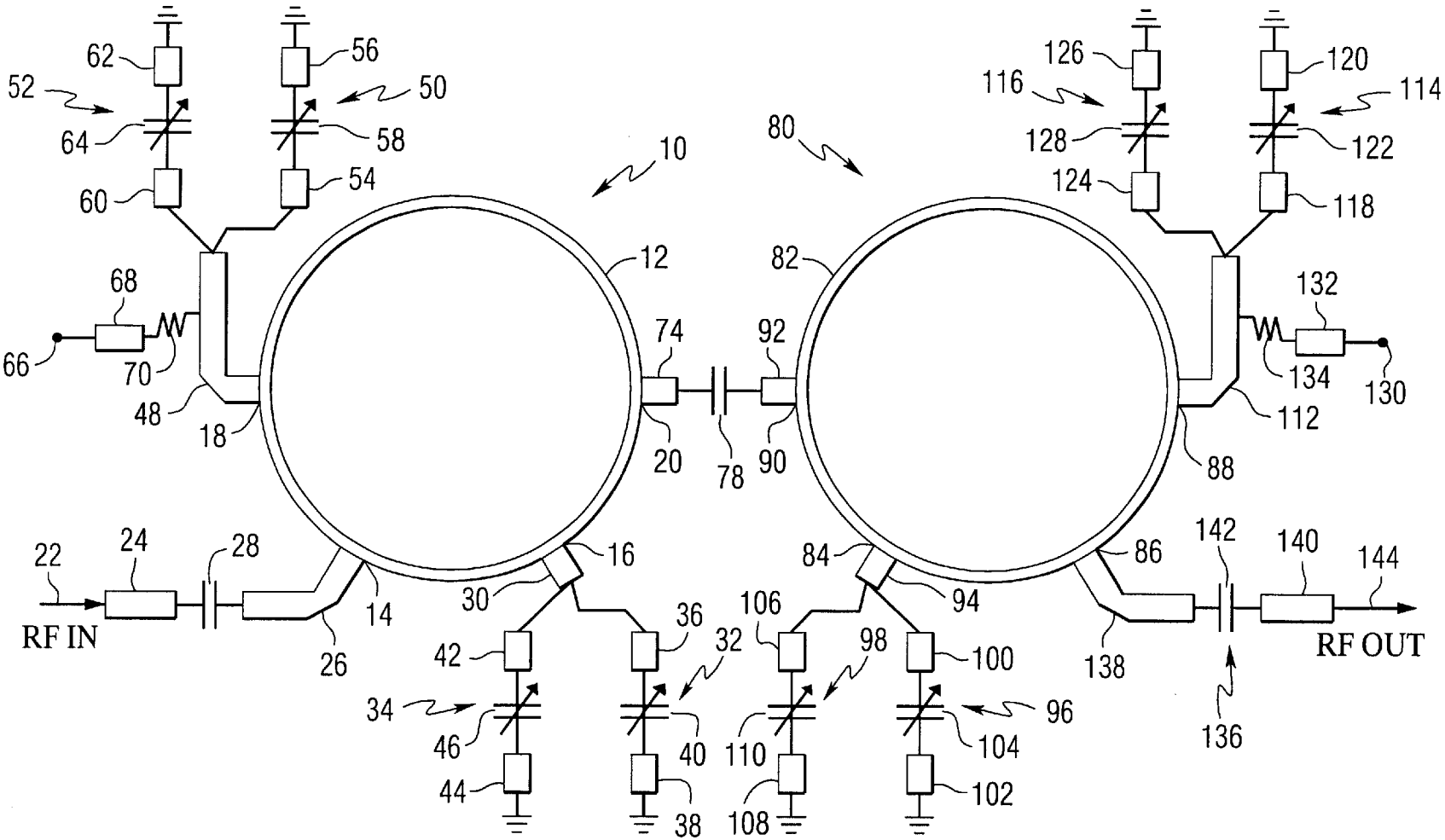
FIG. 2 is a schematic representation of a 360° analog dielectric varactor phase shifter with two 180° analog phase shifters constructed in accordance with this invention.

In order to achieve a 360° phase shift, another 180° analog phase shifter can be added. FIG. 2 is a schematic representation of a 360° analog tunable dielectric varactor phase shifter with two 180° analog phase shifters constructed in accordance with the invention. The phase shifter 80 includes a second rat-race ring 82 having four ports 84, 86, 88 and 90. Port 90 is connected to port 20 of ring 12 through a circuit branch including the series connection of lines 47 and 92, and capacitor 78. Port 84 is connected to line 94, which is in turn connected to a pair of parallel circuit branches 96 and 98. Branch 96 includes the series connection of lines 100 and 102, and capacitor 104. Branch 98 includes the series connection of lines 106 and 108, and capacitor 110. One end of each of the circuit branches is connected to ground. Port 88 is connected to line 112, which is in turn connected to a pair of parallel circuit branches 114 and 116. Branch 114 includes the series connection of lines 118 and 120, and capacitor 122. Branch 116 includes the series connection of lines 124 and 126, and capacitor 128. One end of each of the circuit branches is connected to ground. A terminal 130 is provided for connection to an external bias voltage supply. Terminal 130 is connected to line 112 through a circuit branch including the series connection of line 132 and resistor 134. Port 86 is connected to an output point 144 by way of the series connection of a microstrip lines 138 and 140, and capacitor 142. The two rat-race rings of FIG. 2 are identical and connected in series. The center DC blocking capacitor 78 is used for isolation of the DC bias voltages.

Figure 3:
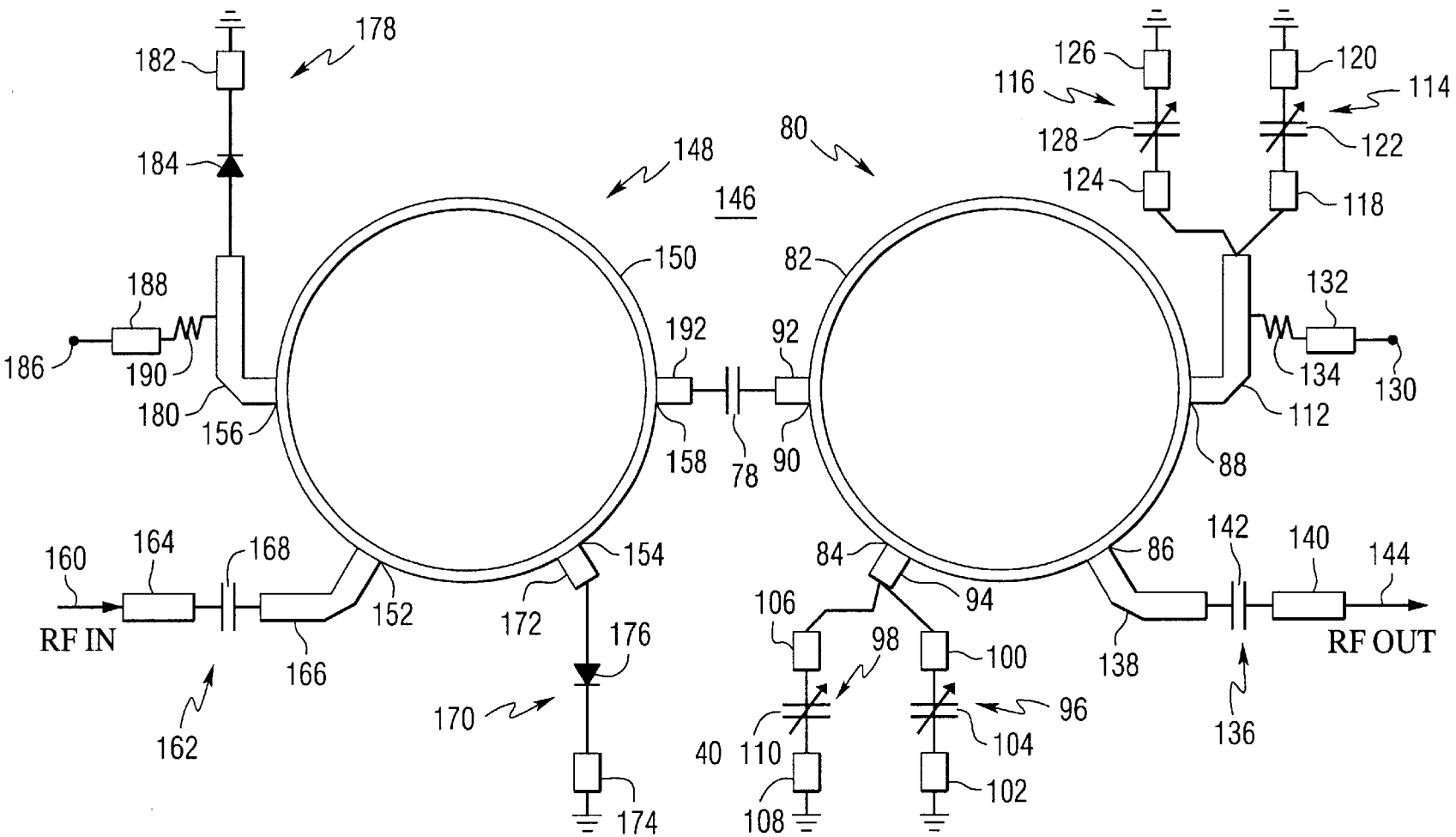
FIG. 3 is a schematic representation of another 360° analog dielectric varactor phase shifter with one 180° digital rat-race phase shifter constructed in accordance with this invention.

FIG. 3 is a schematic representation of another 360° analog dielectric varactor phase shifter 146 constructed in accordance with this invention. The phase shifter of FIG. 3 utilizes the rat-race ring 82 and its associated components and adds a 180° phase shifter 148. Phase shifter 148 includes a ring 150 having ports 152, 154, 156 and 158. Port 152 is connected to an input point 160 through a circuit branch 162 including the series connection of lines 164 and 166, and capacitor 168. Port 154 is connected to ground through a circuit branch 170 including the series connection of lines 172 and 174, and PIN diode 176. Port 156 is connected to ground through a circuit branch 178 including the series connection of lines 180 and 182, and PIN diode 184. A terminal 186 is provided for connection to an external bias voltage supply. Terminal 186 is connected to line 180 through a circuit branch including the series connection of line 188 and resistor 190. Port 158 is connected to ring 82 through the series connection of lines 192 and 92, and capacitor 78. In FIG. 3, the first rat-race ring 150 generates 0 or 180° digital phase shifts by switching the PIN diodes to the on or off states.

Figure 4:
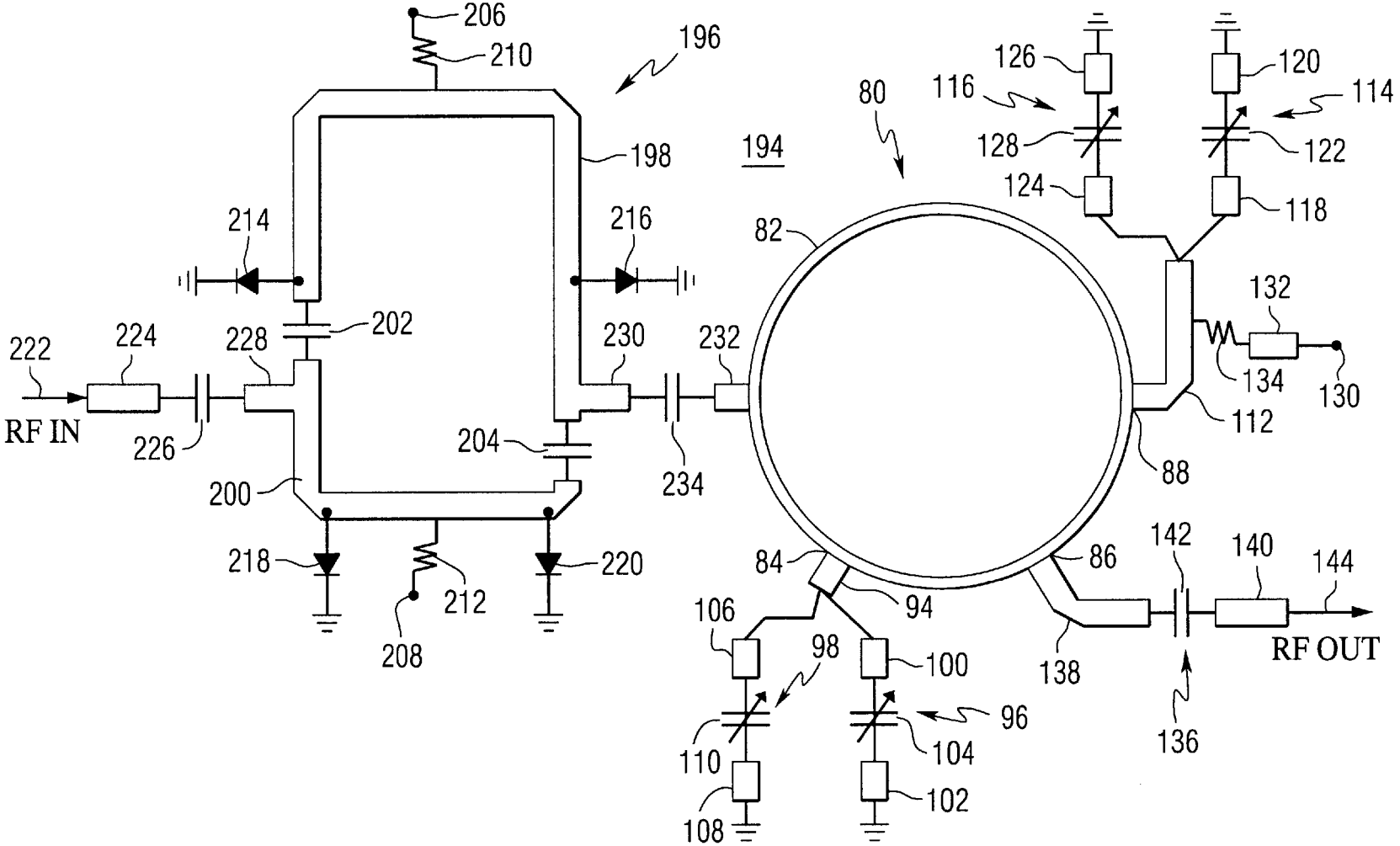
FIG. 4 is a schematic representation of another 360° analog dielectric varactor phase shifter with one 180° digital switched line phase shifter constructed in accordance with this invention.

FIG. 4 is a schematic representation of another 360° analog dielectric varactor phase shifter 194 including a 180° analog rat race ring phase shifter and a 180° digital switch line phase shifter 196 constructed in accordance with this invention. The phase shifter 194 of FIG. 4 utilizes the rat-race ring 82 of FIG. 2, and its associated components and adds a 180° digital switch phase shifter 196. The digital switch phase shifter 196 includes first and second microstrip lines 198 and 200 connected to each other through capacitors 202 and 204. Microstrip line 198 serves as a 180° phase shift line and microstrip line 200 serves as a reference line. Terminals 206 and 208 are provided for receiving a bias voltage. The bias voltage on terminal 206 is application to line 198 through resistor 210. The bias voltage on terminal 208 is application to line 200 through resistor 212. PIN Diodes 214 and 216 are connected between line 198 and ground. PIN Diodes 218 and 220 are connected between line 200 and ground. An RF input 222 is connected to line 200 through the series connection of lines 224 and 226, and capacitor 228. Line 198 is connected to ring 82 through a circuit branch including the series connection of lines 230 and 232, and capacitor 234. The digital switch line phase shifter generates 0 or 180° digital phase shifts by selecting PIN diode switch on or off states. A signal from input 222 can go to either line 198 or 200 depending upon the "on" or "off" state of PIN diodes pairs 214 and 216, or 218 and 220. Two PIN diodes are usually needed to isolate the off-state line from the signal path.

Figure 5:
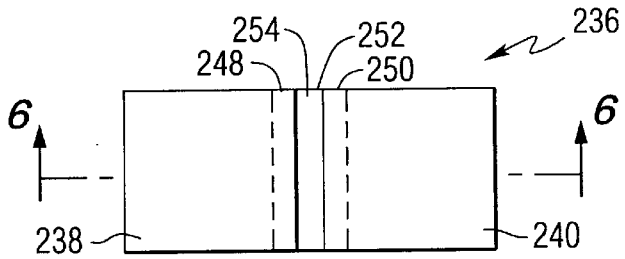
FIG. 5 is a top plan view of a dielectric varactor that can be used in the phase shifters of the present invention.
Figure 6:
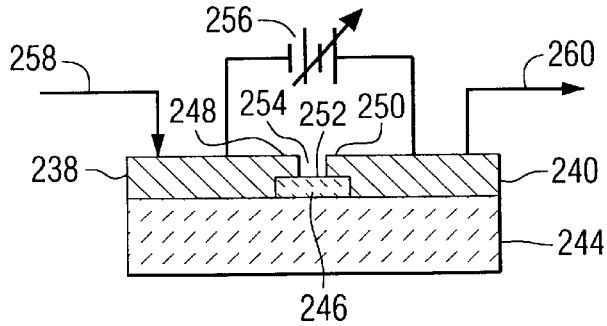
FIG. 6 is a cross sectional view of the dielectric varactor of FIG. 5 taken long line 6—6.

The phase shifters of this invention utilize varactors, which include a low loss, tunable dielectric material having high tuning capabilities. In the preferred embodiments, the material comprises a barium strontium titanate (BST) based composite film. FIG. 5 is a top plan view of a dielectric varactor 236 that can be used in the phase shifters of the present invention; and FIG. 6 is a cross sectional view of the dielectric varactor of FIG. 5 taken along line 6—6. The dielectric varactor 236 includes two planar electrodes 238 and 240 mounted on a surface 242 of a substrate 244. A film of tunable dielectric material 246 is also positioned in the surface of the substrate. Portions 248 and 250 of electrodes 238 and 240 respectively, extend over a surface 252 of the tunable dielectric material and are separated to form a predetermined gap 254. The substrate can, for example, comprise MgO, alumna ($AL_2O_3$), $LaAlO_3$, sapphire, quartz, silicon, gallium arsenide, and other compatible materials to the tunable films and their processing. A voltage supplied by an external variable DC voltage source 256 produces an electric field across the gap adjacent to the surface of the tunable dielectric material, which produces an overall change in the capacitance of the varactor. The width of the gap can range from 10 to 40 $\mu$m depending on the performance requirements. An input 258 is connected to the first electrode 238 and an output 260 is connected to the second electrode 240. The electrodes are constructed of conducting materials, for example, gold, silver, copper, platinum, ruthenium oxide or other compatible conducting materials to the tunable films.

The typical Q factor of the dielectric varactors is 50 to 100 at 20 GHz, and 200 to 500 at 1 GHz with capacitance ratio ($C_{max}/C_{min}$) around 2. The capacitance of the dielectric varactor can vary over a wide range, for example, 0.1 pF to 1.0 nF. The tuning speed of the dielectric varactor is about 30 nanoseconds. The dielectric varactor in the present invention has the advantages of high Q, low intermodulation distortion, high power handling, low power consumption, fast tuning, and low cost, compared to semiconductor diode varactors.

Tunable dielectric materials have been described in several patents. Barium strontium titanate ($Ba_xSr_{1-x}TiO_3$, where x is less than 1), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO-MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference.

The electronically tunable materials that can be used in the varactors of the phase shifters in the preferred embodiments of the present invention can include at least one electronically tunable dielectric phase, such as barium strontium titanate, in combination with at least two additional metal oxide phases. Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.05 to about 0.4, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)5KH_2PO_4$.

In addition, the following U.S. patent applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; and U.S. Provisional application Ser. No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$,$La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. Tunable dielectric materials identified as Parascan™ materials, are available from Paratek Microwave, Inc. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases may include at least two Mg-containing compounds. Alternatively, the metal oxide phase may optionally include Mg-free compounds, for example, oxides of metals selected from Si, Ca, Zr, Ti, Al and/or rare earths, or a single Mg-containing compound and at least one Mg-free compound, for example, oxides of metals selected from Si, Ca, Zr, Ti, Al and/or rare earths.

The present invention provides varactor-tuned rat-race phase shifters. These rat-race phase shifters do not employ bulk ceramic materials as was used in prior art microstrip ferroelectric phase shifters. The bias voltage of these rat-race phase shifters is lower than that of the microstrip phase shifter on bulk material. The thick or thin films of the tunable dielectric material can be deposited onto low dielectric loss and high chemical stability subtracts, such as MgO, $LaAlO_3$, sapphire, $Al_2O_3$, and a variety of ceramic substrates.

The analog 180° phase shifter in the preferred embodiments includes two parallel coupled series resonant circuits. The resonant circuits include a high impendence line, as an inductor, and a dielectric varactor in series. Zero to 180° phase shifts are determined by capacitances of the dielectric varactors, which are controlled by DC voltages.

In alternative embodiments, the present invention also provides 360° varactor-tuned microstrip rat race phase shifters. The varactors (tunable capacitors) preferably include barium strontium titanate (BST) based composite films. These BST composite films have excellent low dielectric loss and reasonable tunability.

While the present invention has been described in terms of what are at present its preferred embodiments, it will be apparent to those skilled in the art that various modifications can be made to the preferred embodiments without departing from the invention as defined by the following claims.

What is claimed is:

1. A phase shifter comprising:

a first rat-race ring having four ports;

an input coupled to a first one of the ports;

an output coupled to a second one of the ports;

a first resonant circuit coupled to a third one of the ports;

a second resonant circuit coupled to a fourth one of the ports, each of the first and second resonant circuits including a tunable dielectric varactor having a Q factor of approximately 50 to approximately 100 at 20 GHz; and a digital switched line phase shifter stage including a first and second microstrip lines coupled to each other by first and second capacitors, an input coupled to the first microstrip line, and output coupled to the second microstrip line, first and second PIN diodes connected between the first microstrip line and ground, third and fourth PIN diodes connected between the second microstrip line and ground, and means for applying a bias voltage to the first and second microstrip lines;

the output of the digital switched line phase shifter stage being coupled to a first one of the first rat-race ring ports.

2. The phase shifter of claim 1, further comprising:

a capacitor electrically connected between the output of the digital switched line phase shifter stage and the first one of the first rat-race ring ports.

* * * * *